United States Patent [19]

Nixon

[11] Patent Number: 4,494,487

[45] Date of Patent: Jan. 22, 1985

[54] ENGINE EFFICIENCY UNIT

[76] Inventor: John Nixon, 11795 E. Grand River, Brighton, Mich. 48116

[21] Appl. No.: 78,149

[22] Filed: Sep. 24, 1979

[51] Int. Cl.[3] ..... F02M 25/00

[52] U.S. Cl. ..... 123/1 A; 123/198 A; 123/523

[58] Field of Search ..... 123/523, 198 A, 1 A; 261/105, 106, 145, 39 B, 36 A

[56] References Cited

U.S. PATENT DOCUMENTS

| | | | |
|---|---|---|---|
| 1,476,701 | 12/1923 | Fleming | 123/523 |
| 1,566,332 | 12/1925 | Lilly | 123/523 |
| 1,640,291 | 8/1927 | Perkins | 261/105 |
| 1,640,711 | 8/1927 | Miller | 123/523 |
| 2,182,874 | 12/1939 | Kowalski | 123/198 A |
| 2,216,477 | 10/1940 | Sullivan | 123/198 A |
| 2,262,013 | 11/1941 | Lang | 123/523 |
| 2,323,721 | 7/1943 | McLindon | 261/105 |
| 2,644,440 | 7/1953 | Bailey | 123/198 A |
| 3,174,472 | 3/1965 | Balogh | 123/198 A |
| 3,722,837 | 3/1973 | Dapprich | 123/523 |
| 3,743,258 | 7/1973 | Florentine | 261/105 |
| 3,864,105 | 2/1975 | Davis | 261/105 |
| 4,096,829 | 6/1978 | Spears | 123/198 A |

OTHER PUBLICATIONS

The Chemical Technology of Petroleum by Wm. A. Gruse & Donald R. Stevens 1942, p. 71.

Organic Chemistry, by Morrison & Boyd, Second Edition, 10/1969, pp. 107–111, 137.

*Primary Examiner*—Ronald H. Lazarus

*Attorney, Agent, or Firm*—Gifford, VanOphem, Sheridan, Sprinkle & Nabozny

[57] ABSTRACT

An engine efficiency device is provided for use in conjunction with an internal combustion engine having an air intake means, such as a carburetor, for mixing fuel with the inducted air to form a combustible charge for the engine. The engine efficiency device comprises a source of petroleum distillates and a pump which feeds the petroleum distillates from the source and into the inducted air flow to the engine continuously during the operation of the engine. In the preferred form of the invention, the petroleum distillate is an aliphatic petroleum naptha-mineral spirit produced by the process of alkylation.

10 Claims, 2 Drawing Figures

ENGINE EFFICIENCY UNIT

BACKGROUND OF THE INVENTION

I. Field of the Invention

The present invention relates to an engine efficiency device for improving combustion in an internal combustion engine.

II. Description of the Prior Art

In view of the high costs of gasoline and other petroleum base products, there have been a number of different devices and chemicals designed to increase the efficiency of internal combustion engines. Many of these efforts have been particularly directed to reciprocal piston internal combustion engines of the type used on most cars, trucks and other vehicles.

One previously known method designed to increase the efficiency of the engine is to spray a mixture of saturated hydrocarbons and other chemicals into the carburetor air intake while the engine is either idling or stopped. The saturated hydrocarbons and the other chemicals are used primarily to dissolve gums, varnish and carbons within both the carburetor and also the engine. Such mixtures effectively free sticky engine valves and generally clean the carburetor orifices, the choke and the throttle linkages to reduce engine friction and thus increase the efficiency of engine operation. Such mixtures, however, are only used at widely spaced periodic intervals to, in effect, "tune-up" the engine.

These previously known mixtures of saturated hydrocarbons and other chemicals are not introduced into the engine during the normal range of engine operation thus have no effect on the actual engine combustion during normal engine operating conditions.

SUMMARY OF THE PRESENT INVENTION

The present invention provides a device which improves engine efficiency by improving the fuel combustion within the engine.

The device of the present invention will be disclosed for use with a reciprocal piston internal combustion engine of the type having a carburetor with an air intake and an air cleaner mounted to the carburetor air intake. Such internal combustion engines are commonly found in cars and other types of vehicles. No undue limitation, however, should be drawn from the description since the device of the present invention can also be used with different types of internal combustion engines, for example, an internal combustion engine which utilizes fuel injectors rather than a carburetor.

In brief, the device according to the present invention comprises a source of petroleum distillates and a pump having its intake connected to the source of the distillates. The pump can be operated by any conventional means, such as mechanically driven by the engine, electric, vacuum or a gravity feed pump.

The outlet from the pump in turn is connected to a nozzle secured to the air cleaner housing so that petroleum distillates from the source are sprayed into the interior of the air cleaner housing and thus into the air flow inducted into the engine. Moreover, the injection of the petroleum distillates into the inducted air flow to the engine occurs continuously over the entire range of the engine operating conditions.

In the preferred form in the invention, the air cleaner housing includes a lower depression around its entire periphery which forms a reservoir into which excess petroleum distillates from the nozzle are collected. In order to enhance the mixing of the petroleum distillates with the inducted air flow to the engine, a wick is disposed entirely around the air cleaner within the air cleaner housing and has one end positioned within the reservoir. Thus, air flow into the air cleaner housing must first flow through the wick which is saturated with the petroleum distillates thus enhancing the mixing of the petroleum distillates with the inducted air flow to the engine. A return line is also connected from the reservoir and to the source of the petroleum distillates in order to recirculate the excess petroleum distillate back to the injection nozzle.

The injection of the petroleum distillates into the engine inducted air flow over the entire range of engine operating conditions aids significantly in engine combustion and, likewise, improves the overall efficiency of the internal combustion engine. In mileage test conducted with automobiles, the device according to the present invention has proven to significantly increase the miles per gallon of gasoline obtainable by the vehicle.

BRIEF DESCRIPTION OF THE DRAWINGS

A better understanding of the present invention will be had upon reference to the following detailed description when read in conjunction with the accompanying drawings, where like reference characters refer to like parts throught the several views, and in which.

DETAILED DESCRIPTION OF THE PRESENT INVENTION

Figure 1:
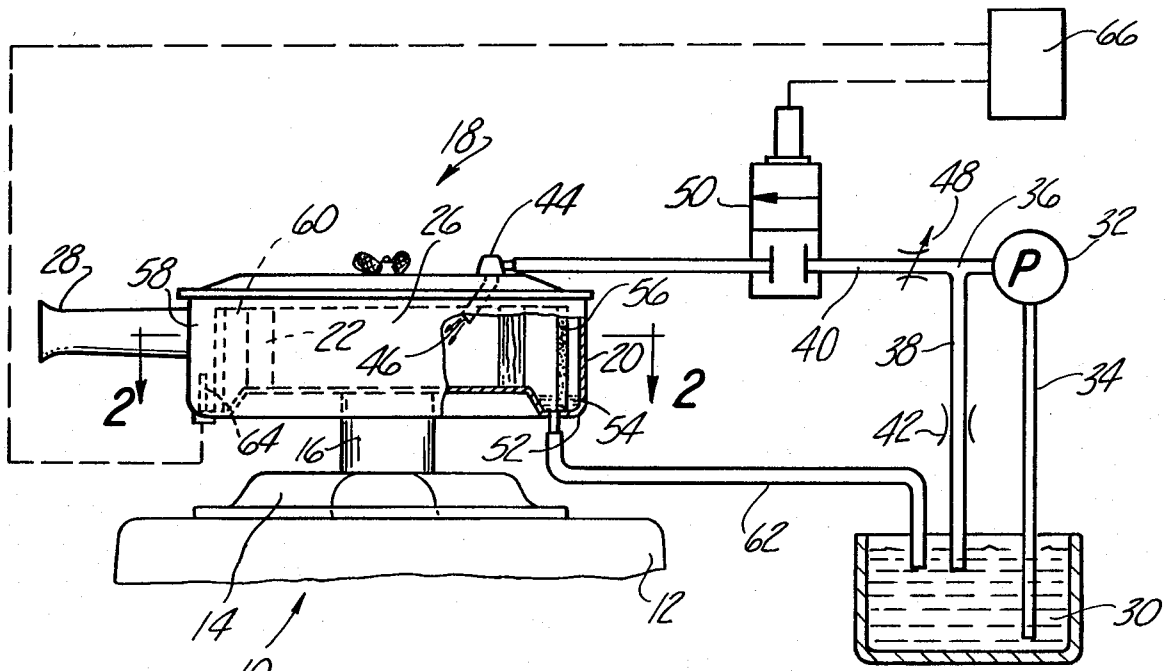
FIG. 1 is a diagrammatic view illustrating the engine efficiency unit of the present invention.

With reference first to FIG. 1, the engine efficiency unit 10 according the present invention is thereshown connected with an internal combustion engine 12 having an intake mainfold 14 on which a carburetor 16 is mounted. The engine carburetor 16 operates in the conventional fashion by introducing gasoline into the inducted air flow into the engine 12 and thus producing a combustible charge for the engine 12.

Figure 2:
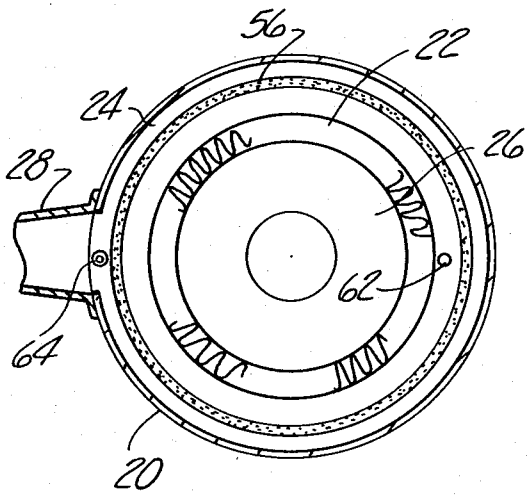
FIG. 2 is a sectional view taken substantially taken along line 22 in FIG. 1.

Referring now to FIGS. 1 and 2, an air cleaner means 18 is mounted to the carburetor 16 and includes a generally cylindrical housing 20 in which an air cleaner element 22 is positioned. The air cleaner element 22 is tubular and cylindrical in shape and is positioned radially inwardly from the outer walls of the air cleaner housing 20. Thus, the air filter element 22 defines an outer annular chamber 24 and an interior chamber 26 which is open to the intake manifold 14 via the carburetor 16. An inlet tube 28 on the air cleaner housing 20 is open to the annular chamber 24 so that air inducted through the inlet tube 28 passes into the annular chamber 24, through the filter element 22 and is inducted into the engine 12 via the air cleaner chamber 26.

With reference now to FIG. 1, the engine efficiency device 10 according to the present invention comprises a source 30 of petroleum distillates and a pump 32 having its intake 34 connected to the source 30 of petroleum distillates. The pump 32 can be of any conventional construction such as an electric pump, a vacuum or gravity said pump or a pump which is mechanically connected to and driven by the engine 12.

The pump 32 further includes an outlet 36 which is connected to two fluid lines 38 and 40. The fluid line 38 is a return line to the source 30 via a bypass valve 42 so that a portion, and preferably the majority, of the petroleum distillates flowing through the pump 32 is immediately returned to the petroleum distillate source 30.

The second pump outlet line 40 is connected to the inlet of a spray nozzle 44 secured to the air cleaner housing 20 and having a outlet 46 open to the interior air cleaner chamber 26. Thus, upon operation of the pump 32, a portion of the petroleum distillates from the source 30 is pumped to the nozzle 44 and out its outlet 46 into the air cleaner interior chamber 26 whereupon the petroleum distillate intermixes with the inducted air flow into the engine 12.

Still referring to FIG. 1, a variable restriction valve 48 is connected in series with the second pump outlet line 40 so that the flow of petroleum distillates from the source 30 and to the nozzle 44 can be controlled and varied as desired. In addition, a solenoid operated valve 50 is also connected in series with the second pump outlet line 40. The solenoid valve is normally open to permit the free flow of petroleum distillate through the pump outlet line 40. When activated, however, the solenoid valve 50 interrupts the fluid flow through the pump outlet line 40 and, in this event, the fluid flow through the return line 38 is simply increased.

In practice, it has been found that not all of petroleum distillates injected into the chamber 26 by the nozzle 44 become intermixed with the inducted air flow into the engine 12 in the desired fashion. As a result of this, the excess petroleum distillates descends to the bottom of the air cleaner housing 20 and collects within an annular depression 52 formed in the bottom of the air cleaner housing 20 and about its outer periphery. The depressed portion 52 of the air cleaner housing 20 in effect forms an annular fluid reservoir at the bottom of the outer annular chamber 24 and within the air cleaner housing 20.

In an effort to recirculate the excess petroleum distillates from the reservoir 54 and back into the inducted air flow to the engine 12, a circular porous sheet 56 of material is disposed within the air cleaner housing 20 so that the sheet 56 is positioned entirely around the air filter element 22 and thus subdivides the annular chamber 24 into an outer annular chamber 58 and inner annular chamber 60. In addition, the bottom of the sheet 56 is positioned within the fluid reservoir 54 and thus acts as a wick to draw petroleum distillates from the reservoir 54, into the sheet 56 and thus into the path of inducted air flow into the air cleaner housing 20. Since the sheet 56 subdivides the air cleaner chamber 24, all the air which is inducted into the air cleaner housing 20 must pass through the wick 56.

In order to prevent an excessive accumulation of the petroleum distillates within in the reservoir 54, an overflow return line 62 has one end connected with the reservoir 54 and its other end connected to the petroleum distillate source 30. When the fluid level within the reservoir 54 exceeds a predetermined level, the excess petroleum distillate overflows into the return line 62 and is returned to the source 30. A level detector 64 is also positioned within the reservoir 54 to activate the solenoid valve 50 and terminate the supply of petroleum distillate to the air cleaner housing 20 when the fluid level within the reservoir 54 exceeds a predetermined level. In addition, a time delay 66 is also connected with the solenoid valve 50 in order to delay the supply of petroleum distillate to the nozzle 44 following engine ignition in order to permit the engine to first reach its normal operating temperature.

Although a wide variety of petroleum distillates can be used, in the preferred form of the invention, the petroleum distillates is of the general formula of $C_nH_{2n+2}$ where n is in the range of 11 to 13.

In particular, a product known as ODORLESS MINERAL SPIRIT produced by the American Mineral Spirits Company, Division of Union Oil of California, can be used as the petroleum distillate, for the present invention. This product is synthesized from petroleum gases by the process of alkylation and has proven extremely effective in operation for use with the efficiency unit 10 according to the present invention. This product has a boiling point of between 179–191 degrees Celsius and a specific gravity of .76.

In operation, the addition of the petroleum distillate to the engine air flow via the nozzle 44 and wick 56 increases the overall efficiency of the engine. When tested on a motor vehicle, significant increases in gas mileage figures were acheived by using device 10 of the present invention and while adding the petroleum distillate to the engine air flow at a rate of approximately 5 milliliters per mile. No limitations, however, should be drawn from this since other rates of fluid flow of the petroleum distillate may likewise increase the overall engine efficiency by a greater or lesser amount.

The precise method by which the device 10 according the present invention increases the overall efficiency of the engine is not entirely known at this time. However, it is thought to improve the overall combustion of the normal engine fuel (typically gasoline) in the engine and in this fashion increase the efficiency of the engine.

Having described my invention, however, many modifications thereto will become apparent to those skilled in the art to which it pertains without deviation from the spirit of the invention as defined by the scope of the appendant claims.

I claim:

1. For use in conjunction with an internal combustion engine having an air intake means for inducting an air flow into the engine, a fuel source and fuel mixing means for forming a combustible charge from fuel from the fuel source with the inducted air flow for the engine, a device for improving the efficiency of the engine comprising:

a source consisting of liquid petroleum distillates, said source of distillates being separate from said fuel source, said distillates having the general formula of $C_nH_{2n+2}$, and means separate from said fuel mixing means for continuously feeding the petroleum distillate from said source into said inducted air flow during operation of the engine.

2. The invention as defined in claim 1 wherein said feeding means further comprises a nozzle having an inlet and an outlet, said nozzle outlet being open to said air flow, a fluid pump having an inlet and an outlet, first means for fluidly connecting the pump inlet to the source of distillates and second means for fluidly connecting the pump outlet to the nozzle inlet.

3. The invention as defined in claim 2 and further comprising flow regulator means for limiting the rate of fluid flow from said pump and to said nozzle.

4. The invention as defined in claim 2 wherein said engine includes an air cleaner upstream from the fuel mixing means, said air cleaner having a housing with an interior chamber, and wherein said nozzle is mounted to the air cleaner housing and has its outlet open to the air cleaner chamber.

5. The invention as defined in claim 4 wherein the lower portion of said air cleaner housing forms a reservoir in which excess petroleum distillate from the nozzle is collected, said device further comprising means for returning petroleum distillate from said reservoir and to said source.

6. The invention as defined in claim 5 wherein said air cleaner housing includes an air inlet, said device further comprising a porous and absorbent member mounted within said air cleaner housing between said air inlet and said air intake means, said absorbent member being at least partially positioned within said reservoir.

7. The invention as defined in claim 5 and including means for selectively deactivating said feeding means when the petroleum distillate in said reservoir exceeds a predetermined level.

8. The invention as defined in claim 7 wherein said deactivating means comprises a fuel level sensor positioned in said reservoir and a solenoid shut off valve fluidly connected to said means for fluidly connecting said pump to said nozzle, said fluid level sensor being operatively connected to said solenoid shut off valve.

9. The invention as defined in claim 8 and further comprising time delay means operatively connected to said solenoid shut off valve to shut off said valve for a predetermined period of time following start up of the engine.

10. The invention as defined in claim 1 wherein said distillate is a hydrocarbon having a formula of $C_nH_{2n+2}$ and wherein n is in the range of ten to thirteen.

* * * * *